US006583766B1

(12) United States Patent
Rawnick et al.

(10) Patent No.: US 6,583,766 B1
(45) Date of Patent: Jun. 24, 2003

(54) SUPPRESSION OF MUTUAL COUPLING IN AN ARRAY OF PLANAR ANTENNA ELEMENTS

(75) Inventors: James J. Rawnick, Palm Bay, FL (US); Timothy E. Durham, Palm Bay, FL (US); Anthony M. Jones, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/039,152

(22) Filed: Jan. 3, 2002

(51) Int. Cl.[7] ..... H01Q 1/38; H01Q 1/52
(52) U.S. Cl. ..... 343/841; 343/700 MS; 343/846
(58) Field of Search ..... 343/700 MS, 841, 343/846

(56) References Cited

U.S. PATENT DOCUMENTS 4,414,550 A * 11/1983 Tresselt ..... 343/700 MS
4,460,894 A * 7/1984 Robin et al. ..... 343/700 MS
5,926,137 A 7/1999 Nealy ..... 343/700 MS

OTHER PUBLICATIONS

Dissertation entitled, "Design of a Broadband Array Using the Foursquare Radiating Element", Carey G. Buxton, Jul. 12, 2001.

* cited by examiner

*Primary Examiner*—Michael C. Wimer
(74) *Attorney, Agent, or Firm*—Akerman Senterfitt

(57) ABSTRACT

The invention concerns a method and apparatus for reducing mutual coupling among adjacent planar antenna radiating elements in an array. The elements can be positioned adjacent to one another in a standard geometric array configuration. A circumferential conductive metal line is provided in the plane of each element at an outer perimeter thereof. The conductive metal line is electrically connected to a ground potential. The ground plane potential is preferably provided by a ground plane reflector over which the antenna elements are suspended. The conductive metal line can be connected to the ground plane reflector by one or more ground posts extending between the conductive metal line and the ground plane reflector.

22 Claims, 3 Drawing Sheets

SUPPRESSION OF MUTUAL COUPLING IN AN ARRAY OF PLANAR ANTENNA ELEMENTS

BACKGROUND OF THE INVENTION

1. Technical Field

The inventive arrangements relate generally to methods and apparatus for providing improvements to planar antenna elements in an array, and more particularly to reducing the undesirable effects caused by mutual coupling among adjacent array elements.

2. Description of the Related Art

Phased array antenna systems are well known in the antenna art. Such antennas are generally comprised of a plurality of radiating elements that are individually controllable with regard to relative phase and amplitude. The antenna pattern of the array is selectively determined by the geometry of the individual elements and the selected phase/amplitude relationships among the elements. Typical radiating elements for such antenna systems may be comprised of dipoles, slots or any other suitable arrangement.

In recent years, a variety of new planar type antenna elements have been developed which are suitable for use in array applications. One example of a planar antenna element is disclosed in U.S. Pat. No. 5,926,137 to Nealy, the disclosure of which is hereby incorporated by reference. The planar type antenna-radiating element disclosed therein is commonly known in the art as the Foursquare antenna. The design is a dual polarized, moderately wideband element that consists of a printed metalization on a low loss substrate suspended over a ground plane reflector. Various polarizations can be achieved with the Foursquare element. For example, dual linear, circular and elliptical polarizations of any orientation or sense are possible. The Foursquare element can be arranged into an array to produce a highly directive beam. The array beam can then be scanned by adjusting the relative phase of the elements according to conventional practice.

Broadband array antennas offer many benefits as compared to narrow band arrays in a wide variety of applications ranging from wireless broadband communications systems to radar systems for the military. However, broadband arrays are known to be difficult to design due to certain conflicting design criteria. Most notable among these are the challenges associated with selection of suitable broadband antenna radiating elements. In addition, close spacing of certain planar antenna elements in an array has proven to be a problem due to the mutual coupling in the array among the individual elements. Such coupling can be used advantageously to achieve wider bandwidths than would otherwise be possible for individual elements. However, the mutual coupling which allows increased performance with regard to bandwidth can also have certain negative effects. For example, such mutual coupling may distort theoretical antenna patterns where the effect of coupling is not included and change the input impedance of individual elements at a selected operating frequency.

Some research efforts have attempted to deal with the effects of mutual coupling in the array context by addressing these issues in the initial design of the individual array elements. However, this creates an added level of design complexity that is undesirable in many systems. What is needed is an improved arrangement for reducing the mutual coupling effect without substantially increasing the size or weight of the radiating elements. For example, it has been found that mutual coupling has been reduced in the case of some kinds of array elements by positioning the element in a cavity. Problems with this approach include increased cost and weight, as well as a greater complexity in the mechanical design of the array.

SUMMARY OF THE INVENTION

The invention concerns a method and apparatus for reducing mutual coupling among adjacent planar antenna radiating elements in an array. The elements can be positioned adjacent to one another in a standard geometric array configuration. A circumferential conductive metal line is provided in the plane of each element at an outer perimeter thereof. The conductive metal line is electrically connected to a ground potential. The ground plane potential is preferably provided by a ground plane reflector over which the antenna elements are suspended. The conductive metal line can be connected to the ground plane reflector by one or more ground posts extending between the conductive metal line and the ground plane reflector.

The individual antenna elements comprising the array can be formed of a radiating element portion provided on a dielectric layer. For example, the radiating element can be etched from a copper cladding formed on the dielectric layer. The conductive line can also be etched from the copper cladding so that the radiating element and the line are in a common plane. According to one embodiment, the radiating element portion can be a Foursquare antenna radiating element.

The invention can also include an individual antenna element for providing reduced coupling when positioned among a plurality of adjacent antenna elements in an array. In that case, the individual antenna element comprises a dielectric layer, a radiating element formed on the dielectric layer, and a circumferential conductive metal line in the plane of the radiating element. The radiating element can be formed as a Foursquare type element, but the invention is not so limited. The circumferential metal line can be spaced from the radiating element to form an outer perimeter thereof. The conductive metal line is connected to a ground potential such as a ground plane reflector over which the element is suspended. The circumferential conductive metal line can be electrically connected to the ground plane by at least one ground post extending between the conductive metal line and the ground plane reflector. According to one aspect of the invention, the antenna radiating element and the conductive metal line are each formed from a copper cladding on the dielectric layer so that they form a common plane.

The invention can also include a scannable array of planar radiating elements having reduced mutual coupling. The radiating elements can be formed in a Foursquare configuration, but the invention is not so limited. According to one embodiment, a plurality of the antenna elements as described herein can be arranged adjacent to one another in an array configuration with a plurality of feed points connected to the radiating elements. An RF controller can be provided for controlling at least one of a phase and amplitude of RF applied to the radiating elements at the feed points. A circumferential conductive metal line can be provided in the plane of each the element at an outer perimeter thereof and is advantageously connected to a ground potential such as a ground plane reflector over which the element is suspended. The connection to the ground plane can be provided by one or more ground posts extending between the conductive metal line and the ground plane reflector. At least one of the radiating elements can be a foursquare antenna radiating element, but the invention can also be implemented with a variety of other well known antenna radiating elements.

DETAILED DESCRIPTION OF THE INVENTION

Figure 1:
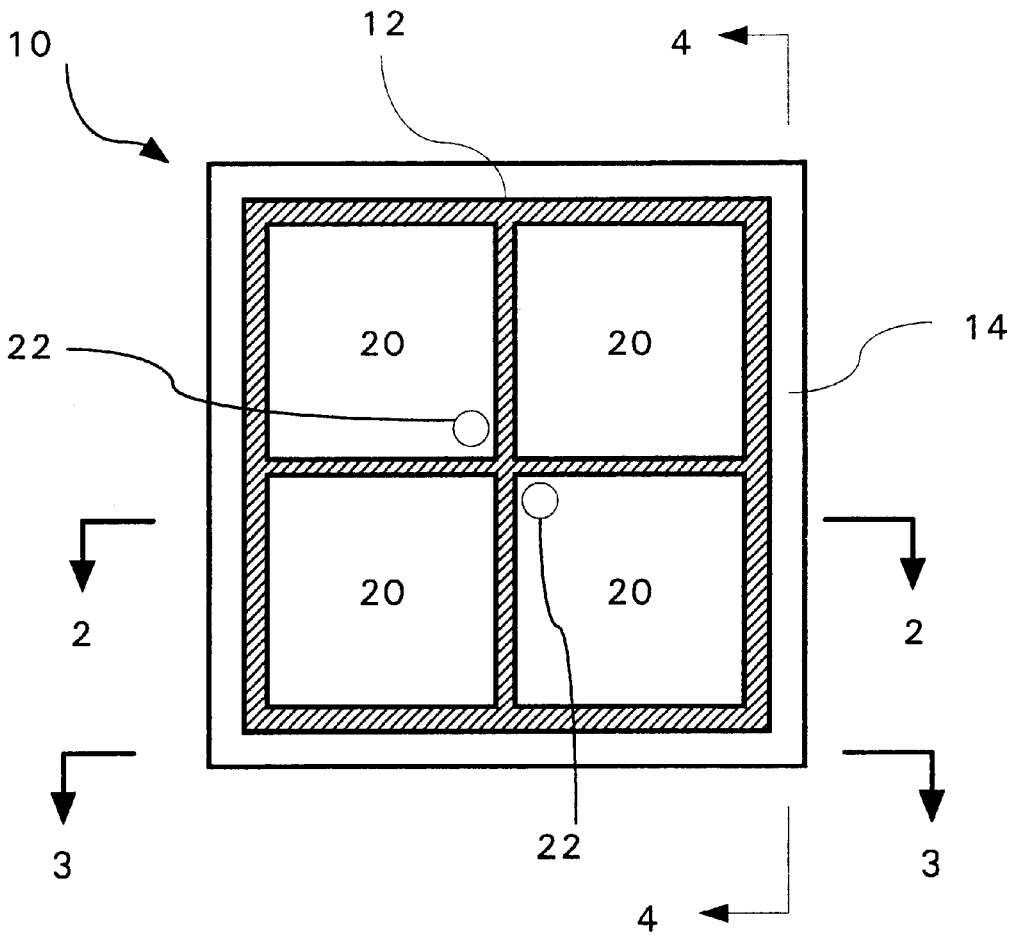
FIG. 1 is a top view of an antenna element with mutual coupling suppression utilizing a circumferential conductive line.
Figure 2:
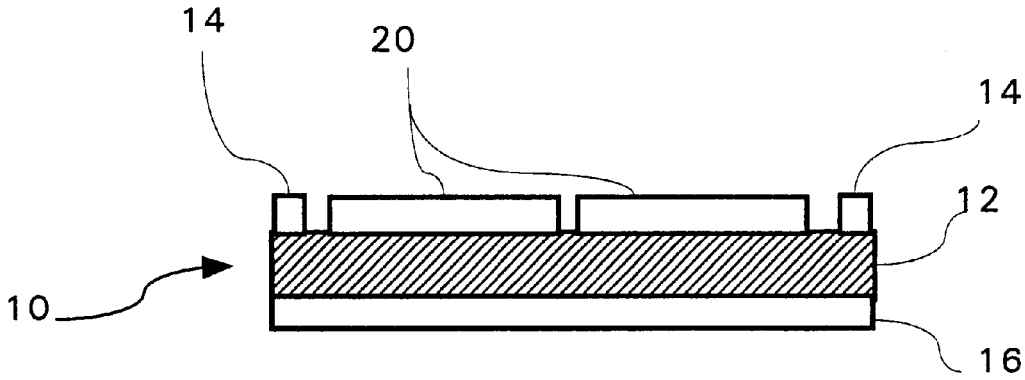
FIG. 2 is a cross-sectional view of the antenna element in FIG. 1 taken along line 2—2 in FIG. 1.

FIG. 1 is a top view of an antenna element 10 which can be used in an array configuration. The antenna element 10 can be comprised of radiating elements 20 which are arranged on the surface of substrate 12. As shown in FIG. 2, a ground plane 16 is preferably provided spaced apart from radiating elements 20 on an opposing surface of the substrate 12. An set of RF feed points 22 fed by balanced feed lines (not shown) can be provided as shown in FIG. 1 on diagonally opposed radiating elements for driving radiating elements 20. A second corresponding set of feed points fed by a second balanced feed line can also conventionally be provided on the remaining two diagonally opposed radiating elements 20. The second corresponding set of feed points and associated feed lines are omitted in FIG. 1 for greater clarity.

Substrate 12 is preferably a low loss substrate comprised of a layered composite material. For example, the substrate can consist of an upper layer of glass microfiber reinforced polytetrafluoroethylene, such as RT/duroid® 5870 having a thickness of 0.028 inches with 1 ounce copper cladding and a lower layer of polystyrene foam having a thickness of 0.250 inches. The four radiating elements 20 are preferably etched onto the copper clad upper layer.

The antenna element shown in FIG. 1 is a Foursquare type element as described in U.S. Pat. No. 5,926,137 to Nealy, the disclosure of which is hereby incorporated by reference. Significantly however, the Foursquare element is shown by way of example and the invention is not so limited. Other configurations of planar radiating elements are also possible. For example, the invention may also make use of other conventional radiating elements such as an archimedean spiral, equiangular spiral, sinuous and microstrip patch designs.

According to a preferred embodiment of the invention, a circumferential conductive line 14 is also provided on the substrate 12 for reducing mutual coupling as between adjacent antenna elements 10 when they are mounted in an array configuration. The conductive line is preferably etched from the copper cladding attached to the substrate 12 in the same manner as radiating elements 20. However, the invention is not so limited and any other suitable means can be employed to provide the conductive line provided that is approximately co-planar with radiating elements 20. For example, the conductive line can be formed by printing a conductive material on the substrate 12, bonding a conductive material to the substrate or doping a portion of the substrate to define the conductive line.

The spacing of conductive line 14 from the perimeter defined by the group of radiating elements 20 is not critical, provided that the line remains approximately in the plane of the radiating elements 20. According to a preferred embodiment, the spacing may advantageously be selected such that the line 14 approximately bisects the distance between antenna element 10 and a corresponding adjacent element 10 in an array. If the line 14 is very close to the radiating elements 20, it may be necessary to adjust the center frequency of the antenna element 10 to compensate for de-tuning effects of the adjacent line.

The physical dimensions of the line are also not critical. Typically, the line 14 can be from between about 1 mil to 10 mils in width, although thinner and thicker lines are also possible. According to a preferred embodiment, the line widths are preferably small relative to the dimensions of the antenna elements 20 so as to minimize the potential for any parasitic effects that might otherwise occur.

The thickness of the line is also not critical, provided that at least a portion of the line is in the plane of the radiating elements 20. The advantageous effects of the line 14 will be substantially diminished if at least a portion of the line does not circumferentially coincide with the plane defined by the radiating elements. Although not necessary, it would be acceptable for the purposes of the invention for the line to extend somewhat above or below the surface of substrate 12.

Figure 3:
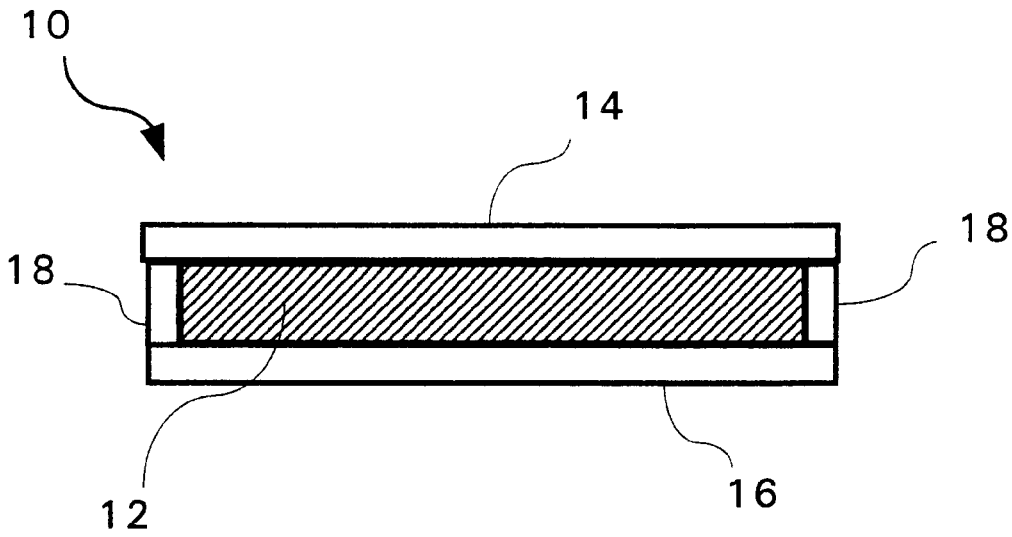
FIG. 3 is a cross-sectional view of the antenna element in FIG. 1 taken along line 3—3 in FIG. 1.
Figure 4:
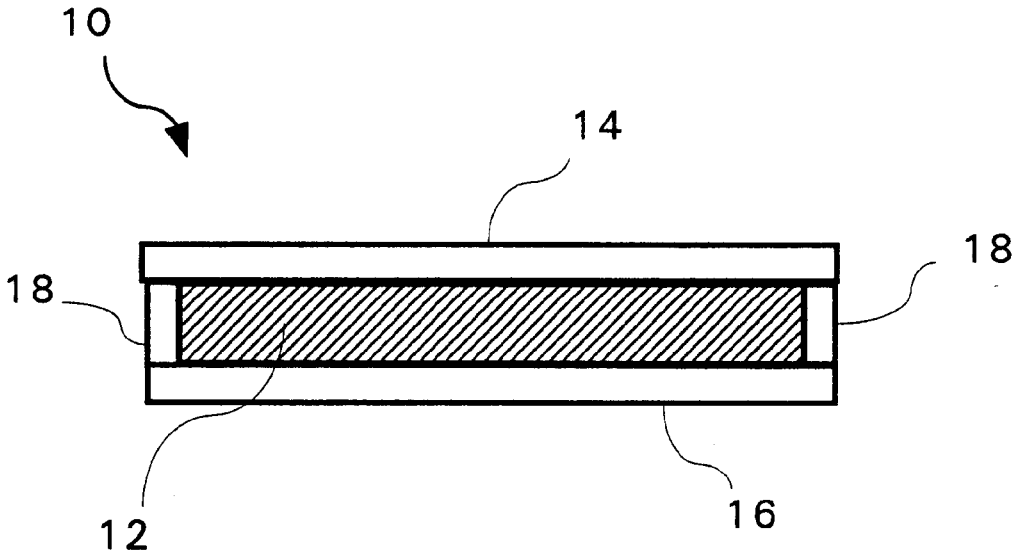
FIG. 4 is a cross-sectional view of the antenna element in FIG. 1 taken along line 4—4 in FIG. 1.

The conductive line 14 is preferably electrically connected to a ground potential for effectively isolating antenna element 10 from adjacent elements of similar design in an array. FIG. 3 is a cross-sectional view of the antenna element in FIG. 1 taken along line 3—3 in FIG. 1. FIG. 4 is a cross-sectional view of the antenna element in FIG. 1 taken along line 4—4 in FIG. 1. As shown in FIGS. 3 and 4, a set of grounding posts 18 are preferably provided for electrically connecting the circumferential line to the ground plane reflector 16. The ground posts 18 can be formed as plated metal paths. Alternatively, any other suitable means can be used for defining a conductive path between the conductive line 14 and the ground plane reflector 16. One ground post is preferably provided at each corner of the element 10 as illustrated in FIGS. 3 and 4. However, the invention is not limited in this regard and alternative grounding arrangements are also possible. For example, more or fewer ground posts can be used and their placement can be adjusted for maximum effectiveness for the selected type of antenna element. Analysis of the Foursquare antenna arrangement shown in FIGS. 1–4 indicates that the four ground posts positioned at each corner of the antenna element 10 reduces antenna coupling between adjacent ones of antenna elements 10 nearly as well as enclosing each element in a separate cavity. However, a single ground post for each element can also be used, with somewhat reduced effectiveness.

The conductive metal line 14 provided as shown provides an effective approach to minimize coupling induced pattern anomalies and VSWR problems in an array of planar antenna elements 10. Significantly, this reduction in mutual coupling is achieved with only a minimal increase in the overall weight and mechanical complexity as compared to other approaches. This approach allows planar antenna elements, such as the Foursquare array, to be used in a tightly packed array without complicating mutual coupling factors.

Figure 5:
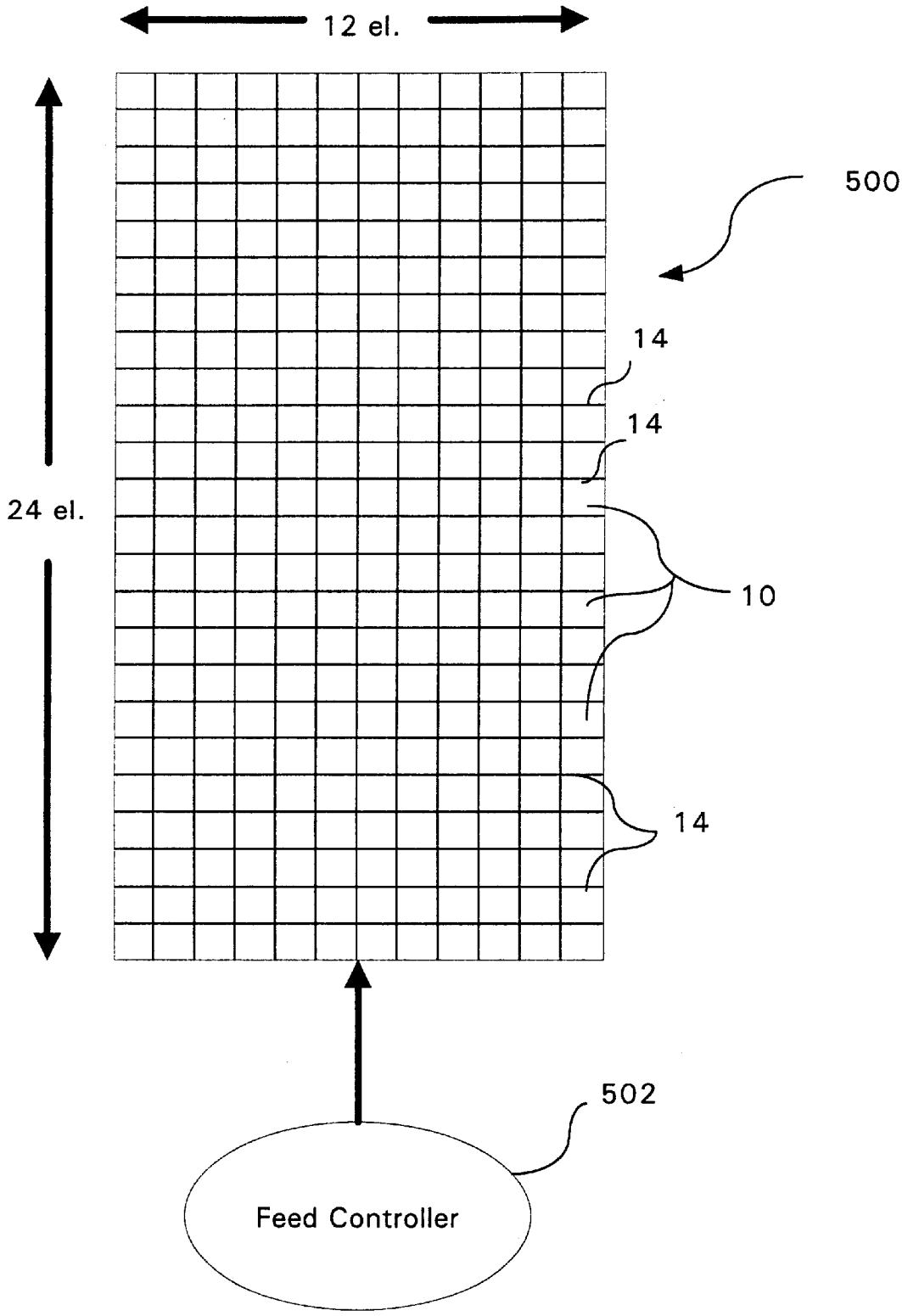
FIG. 5 is a drawing useful for showing the application of the antenna element of FIG. 1 in an array configuration.

FIG. 5 is an illustrative geometry of an array 500 comprised of many antenna elements 10. Conductive lines 14 are provided circumferentially around each antenna element 10 as shown. According to a preferred embodiment, adjacent antenna elements may share a common portion of a conductive line 14 as shown. However, the invention is not so limited and each conductive line 14 may be physically separate from conductive lines 14 of adjacent elements 10. A feed controller 502 is conventionally provided for controlling the scanning of a beam formed by the array. The feed controller 502 connects the array 500 to transmitting and receiving equipment. The feed controller 502 conventionally contains feed lines and phase shifters for controlling the scanning of the beam.

While the invention has been described in terms of a single preferred embodiment, those skilled in the art will recognize that the invention can be practiced with modification within the spirit and scope of the appended claims.

We claim:

1. In an array comprising a plurality of planar antenna elements, a method for reducing mutual coupling among adjacent elements, comprising:

positioning said elements adjacent to one another in a phased array configuration;

providing a circumferential conductor exclusively around each individual one of said elements in a plane common to each said element and spaced from said elements at an outer perimeter thereof so that at least a portion of said circumferential conductor for each said element is common to a circumferential conductor of an adjacent one of said elements; and connecting said circumferential conductor to a ground potential.

2. The method according to claim 1 wherein said ground potential is a ground plane reflector over which said elements are suspended, and further comprising the step of connecting said circumferential conductor to said ground plane reflector by at least one ground post extending between said conductor and said ground plane reflector.

3. The method according to claim 1 further comprising forming a radiating portion of each said antenna element on a dielectric layer.

4. The method according to claim 3 wherein said forming step further comprises etching said radiating element portion from a copper cladding formed on said dielectric layer.

5. The method according to claim 1 wherein said providing step further comprises etching a line from a copper cladding formed on said dielectric layer.

6. The method according to claim 3 wherein said radiating portion is a foursquare antenna.

7. The method of claim 1, further comprising the step of positioning said portion of said circumferential conductor so as to substantially bisect a space between adjacent ones of said antenna elements.

8. A phased antenna array having reduced coupling among a plurality of antenna elements, comprising:

a plurality of planar antenna elements adjacent to one another in an array configuration;

a circumferential conductor exclusively around each individual one of said elements in a plane common to each said element and spaced from said elements at an outer perimeter thereof, said circumferential conductor connected to a ground potential and wherein at least a portion of said circumferential conductor for each said element is common to a circumferential conductor of an adjacent one of said elements.

9. The antenna array according to claim 8 further comprising a ground plane reflector over which said elements are suspended, said circumferential conductor electrically connected to said ground plane reflector by at least one ground post extending between said conductor and said ground plane reflector.

10. The antenna array according to claim 8 wherein each said element further comprises a radiating portion formed on a dielectric layer.

11. The antenna array according to claim 10 wherein said radiating portion is etched from a selected portion of a copper cladding on said dielectric layer.

12. The antenna array according to claim 9 wherein said circumferential conductor is a line etched from said copper cladding.

13. The antenna array according to claim 9 wherein said radiating portion is a foursquare antenna radiating element.

14. The phased antenna array of claim 8, wherein said portion of said circumferential conductor substantially bisects a space between adjacent ones of said antenna elements.

15. An antenna element for providing reduced coupling to a plurality of adjacent antenna elements in a phased array, comprising:

a dielectric layer;

a radiating element formed on said dielectric layer;

a circumferential conductor exclusively around each individual one of said radiating elements in a plane common to each said radiating element and spaced from said radiating element to form an outer perimeter thereof, said circumferential conductor connected to a ground potential and wherein at least a portion of said circumferential conductor for said element is common to a circumferential conductor of an adjacent one of said radiating elements.

16. The antenna element according to claim 15 further comprising a ground plane reflector over which said radiating element is suspended, said circumferential conductor electrically connected to said ground plane by at least one ground post extending between said conductor and said ground plane reflector.

17. The antenna element according to claim 15 wherein said radiating element and said conductor are each formed from a copper cladding on said dielectric layer.

18. The antenna element according to claim 15, wherein said portion of said circumferential conductor substantially bisects a space between adjacent ones of said radiating elements.

19. A scannable array comprising:

a plurality of planar radiating elements adjacent to one another in a phased array configuration;

a plurality of feed points connected to said radiating elements;

controller means for controlling at least one of a phase and amplitude of RF applied to said radiating elements at said feed points;

a circumferential conductor exclusively around each individual one of said elements in a plane common to each said element and spaced from each said element at an outer perimeter thereof, said circumferential conductor connected to a ground potential and wherein at least a portion of said circumferential conductor for each said radiating element is common to a circumferential conductor of an adjacent one of said radiating elements.

20. The scannable array according to claim 19 further comprising a ground plane reflector over which said plurality of elements is suspended, said circumferential conductor electrically connected to said ground plane by at least one ground post extending between said conductor and said ground plane reflector.

21. The scannable array according to claim 19 wherein at least one of said radiating elements is a foursquare antenna.

22. The scannable array according to claim 19 wherein said portion of said circumferential conductor substantially bisects a space between adjacent ones of said radiating elements.

* * * * *

UNITED STATES PATENT AND TRADEMARK OFFICE

CERTIFICATE OF CORRECTION

PATENT NO. : 6,583,766 B1
DATED : June 24, 2003
INVENTOR(S) : Rawnick et al.

It is certified that error appears in the above-identified patent and that said Letters Patent is hereby corrected as shown below:

Column 5,
Line 37, delete “antenna”.
Line 50, delete “elements” and replace with -- element --.

Column 6,
Lines 1 and 4, delete “9” and replace with -- 10 --.

Signed and Sealed this

Tenth Day of May, 2005

JON W. DUDAS
*Director of the United States Patent and Trademark Office*